United States Patent [19]

Rousseau

[11] Patent Number: 4,508,037

[45] Date of Patent: Apr. 2, 1985

[54] DOOR LEVER ADJUSTING DEVICE FOR HOPPER CAR DOORS

[75] Inventor: George L. Rousseau, Homosassa, Fla.

[73] Assignee: Pullman Standard, Inc., Chicago, Ill.

[21] Appl. No.: 381,476

[22] Filed: May 24, 1982

[51] Int. Cl.[3] ..... B61D 7/18; B61D 7/26; B61D 7/28

[52] U.S. Cl. ..... 105/290; 74/522; 105/240; 105/296; 105/299; 105/304; 403/90

[58] Field of Search ..... 105/240, 289, 290, 296, 105/299, 304; 74/522, 525; 248/354 S; 403/4, 26, 33, 44, 55, 90

[56] References Cited

U.S. PATENT DOCUMENTS

| | | | |
|---|---|---|---|
| 763,186 | 6/1904 | Johnson | 105/290 X |
| 1,378,216 | 5/1921 | Christianson | 105/299 |
| 1,908,096 | 5/1933 | Yost | 105/250 |
| 2,197,730 | 4/1940 | Mugford | 74/522 X |
| 2,469,220 | 5/1949 | Zimmer | 105/299 |
| 2,888,882 | 6/1959 | Dorey | 105/250 |
| 3,082,700 | 3/1963 | Dorey | 105/253 |
| 3,137,247 | 6/1964 | Hamilton et al. | 105/299 X |
| 3,185,528 | 5/1965 | Peterson | 105/240 X |
| 3,255,713 | 6/1966 | Lindstrom | 105/244 |
| 3,262,401 | 7/1966 | Gibson | 105/250 |
| 3,291,071 | 12/1966 | Dorey | 105/253 |
| 3,316,857 | 5/1967 | Floehr | 105/299 X |
| 3,385,231 | 5/1968 | Dorey | 105/250 |
| 3,405,655 | 10/1968 | Dorey | 105/250 |
| 3,405,656 | 10/1968 | Dorey | 105/253 |
| 3,434,433 | 3/1969 | Floehr | 105/249 |
| 3,450,065 | 6/1969 | Floehr et al. | 105/304 X |
| 3,596,609 | 8/1971 | Ortner et al. | 105/240 |
| 3,633,515 | 1/1972 | Shaver et al. | 105/290 X |
| 3,730,106 | 5/1973 | Tamborski | 105/253 |

FOREIGN PATENT DOCUMENTS

| | | | |
|---|---|---|---|
| 727804 | 4/1980 | U.S.S.R. | 403/90 |

*Primary Examiner*—Randolph Reese
*Assistant Examiner*—Howard Beltran
*Attorney, Agent, or Firm*—Richard J. Myers

[57] ABSTRACT

In a railway hopper car with several bottom dump doors, the doors are operated by a main door operating member in the form of a thrust bar running the length of the car. The bar, when moved, rotates levers which rotate actuator shafts which move door operating linkage arrangements, opening and closing the dump doors. An adjustable positioning structure is provided on each lever to cause adjustment of the individual dump door positions. The adjustment is accomplished by tightening or loosening bolts in the adjustor, which is fixed on an actuator shaft running to the linkage arrangement. The adjustor and actuator shaft rotate on a bearing with respect to the lever, but are held in locked adjusted position by the adjustor bolts abutting on flanges welded to the lever.

25 Claims, 8 Drawing Figures

FIG. 1
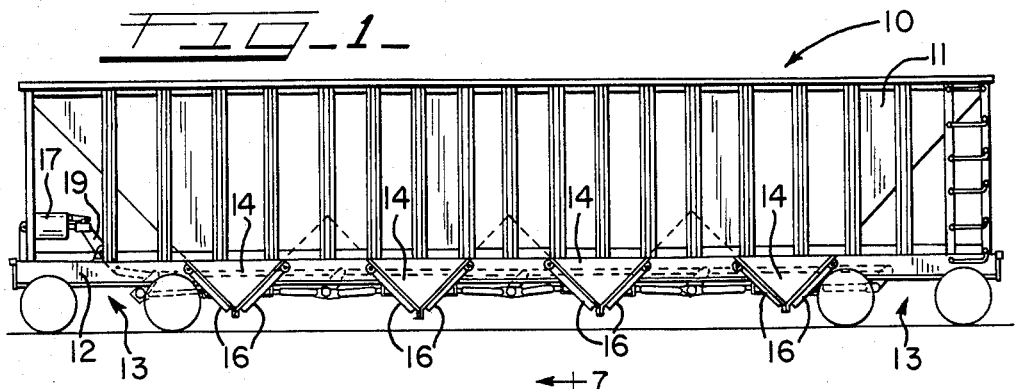
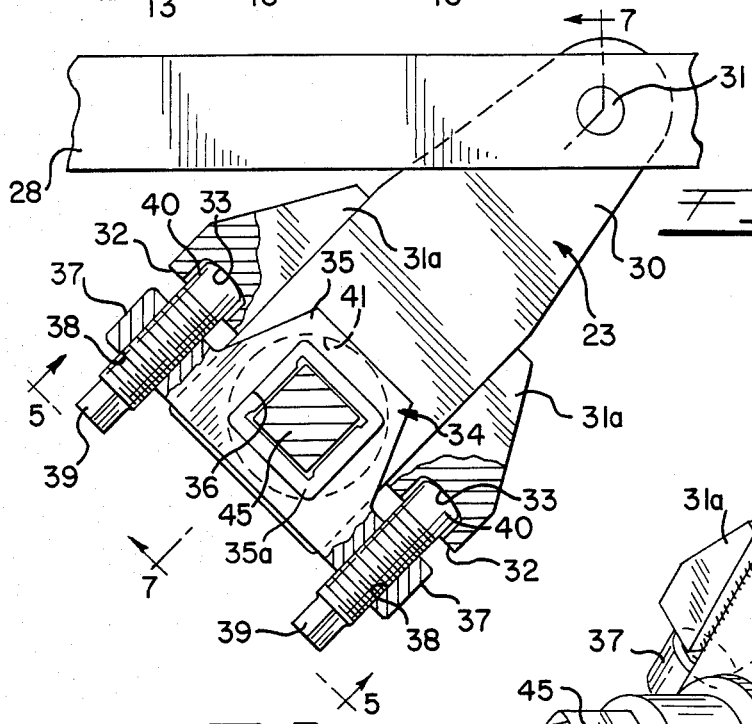
FIG. 4
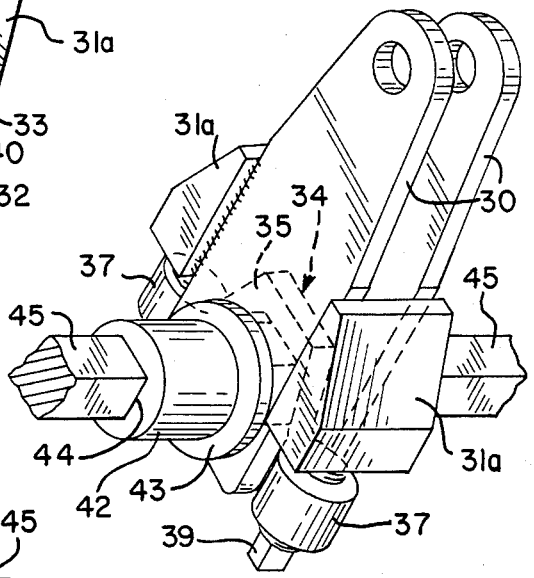
FIG. 6
FIG. 5
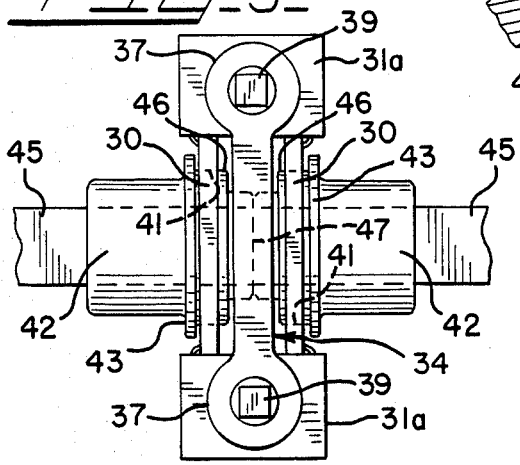

FIG. 2
PRIOR ART
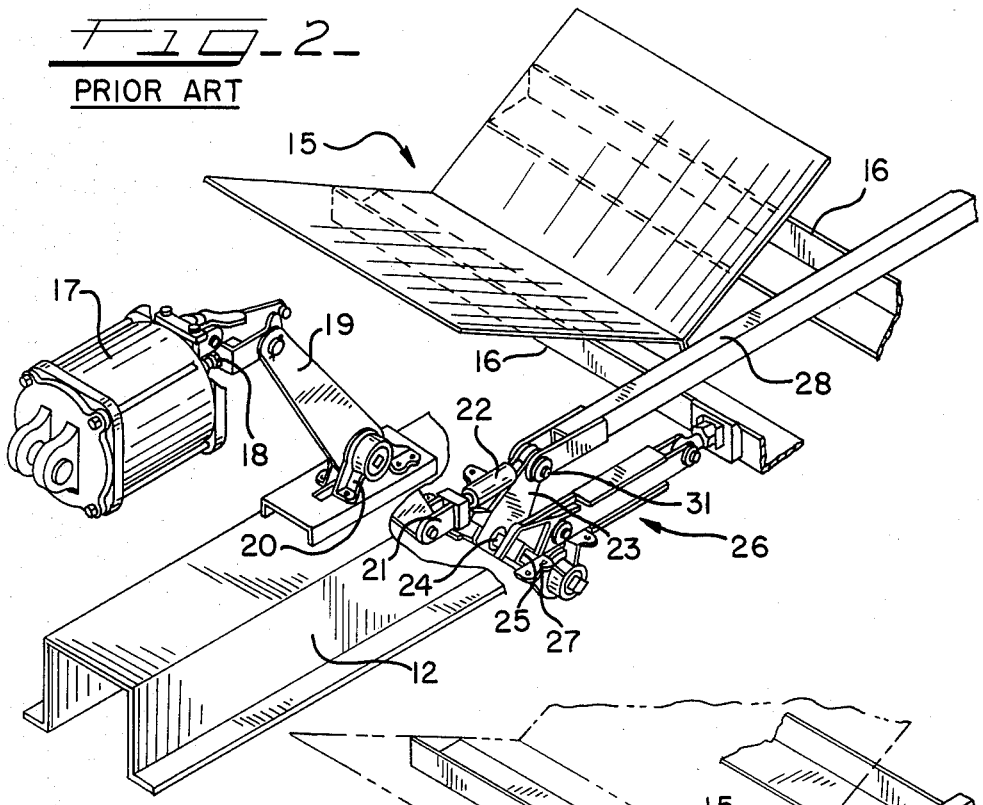
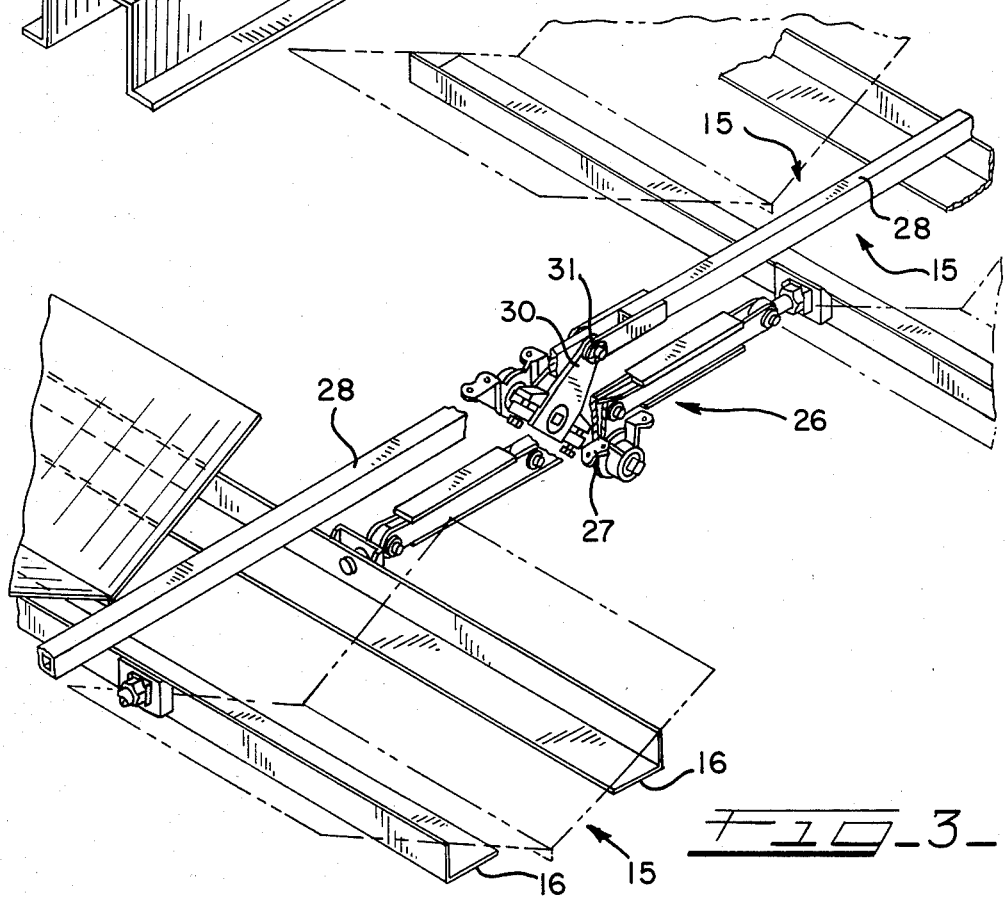
FIG. 3

DOOR LEVER ADJUSTING DEVICE FOR HOPPER CAR DOORS

BACKGROUND OF THE INVENTION

1. Field of the Invention

This invention pertains to bottom dump hopper cars having discharge openings controlled by a plurality of door assemblies which are moved between open and closed positions by a longitudinally movable thrust member which actuates swinging levers connected to the doors by linkage arrangement.

2. Description of the Prior Art

The prior art is illustrated in the drawings and is also disclosed in the Johnson U.S. Pat. No. 763,186 which is concerned with a crank lever and linkage assembly connected by means of linkage to series of doors for opening and closing the same. To adjust the door mechanism relative to the discharge opening, the prior art provides turnbuckles which are interconnected between the thrust bar and crank lever thus permitting adjustment of individual door assemblies.

In the present invention the turnbuckles are eliminated and the adjustment is provided at the lower end of the pivoted lever which is provided for each of the door assemblies. Patents disclosing adjustments other than turnbuckles are Floehr, et al. U.S. Pat. No. 3,450,065, and Dorey U.S. Pat. Nos. 2,888,882 and 3,405,655. The present invention provides a distinct and improved construction of a fine adjustment means for a door assembly which is contained in combination with the door lever, actuating member, and linkage arrangement.

SUMMARY OF THE INVENTION

This invention relates to a hopper door operating mechanism for use in railway hopper cars. In the present car a plurality of pairs of doors are actuated by a door operator which is supported by an underframe center sill, and which includes a longitudinal thrust bar. The center sill also supports a pivoted actuating lever for each of the pairs of doors, these being pivoted by the thrust bar to actuate the linkages for moving the doors between their open and closed positions.

Since a single thrust bar and various linkages are provided for each door assembly, it is necessary to provide for adjustment, either in the thrust bar, or in the linkage arrangement so that each set of doors can be adjusted relative to its position in connection with its discharge opening. In the prior art this is achieved by turnbuckles utilized in the thrust arrangement, or by various adjustments in the operating linkage as disclosed in the aforementioned prior art patents. In the present invention the adjustment is provided in the actuating lever, one of which is provided for each set of doors. The actuating lever comprises a pair of spaced plates, the upper ends thereof being pivotally secured to the thrust bar arrangement and being pivoted thereby. The lower ends of the plates are provided with aligned and spaced openings, each of which contains a bearing, projecting inwardly of the plates and having end portions in abutting contact. The bearings also project outwardly of the plates and support for rotation independent actuating members in the form of rectangular bars which in turn are connected to the linkages which control door operation.

The invention which is described below includes an adjusting mechanism mounted on the lower end of the lever which will permit the required adjustment to properly position each door relative to the discharge opening. Thus it is the primary objective of the present invention to provide an improved adjustment means, directly on the lever, for achieving fine adjustment of the door assemblies.

BRIEF DESCRIPTION OF THE DRAWINGS

FIG. 1 is an elevational view of a railway hopper car;

FIG. 2 is a perspective view disclosing an actuating mechanism for pivoting a plurality of levers of a door opening mechanism, the same being common in the prior art;

FIG. 3 is a perspective view of an improved actuating mechanism;

FIG. 4 is an enlarged view of an actuating lever with portions broken away to illustrate the invention;

FIG. 5 is a bottom view taken along the line 5—5 of FIG. 4;

FIG. 6 is a perspective view of a lever and adjusting mechanism;

DESCRIPTION OF THE PREFERRED EMBODIMENT

Figure 7:
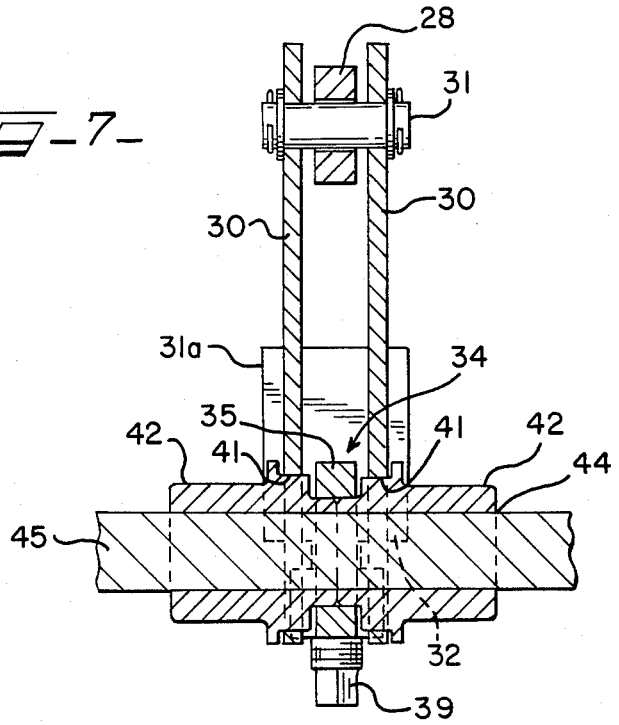
FIG. 7 is a cross sectional view taken along line 7—7 of FIG. 4.

FIG. 1 illustrates the general arrangement of a hopper car 10, having a car body 11, supported on a center sill underframe 12 in turn supported on car trucks 13. The hopper car 10 is provided with a plurality of individual hoppers 14 which are provided with discharge openings 15 disposed on opposite sides of the center sill 12.

Each of the openings 15 is regulated by door assemblies 16, a pair of which is provided for each opening 15. The prior art and the improved design of this invention include a fluid extensible device 17 which is suitably mounted on the car body 11. The extensible device 17 includes a ram 18 which is pivotally connected to an actuating lever 19 pivotally supported on a pivot bracket 20 suitably supported on the center sill 12. The lever 19 at its lower end portion is pivotally connected to clevis member 21 which in the prior art is connected to a turnbuckle link 22 in turn pivotally connected to an actuating lever 23. In the improvement the turnbuckle would be ommitted and a non adjustable thrust link would connect the clevis 21 to the lever 23. The lever 23, has connected thereto, as shown in the prior art FIG. 2, a square shaft actuating bar 24, which in turn extends through a square opening 25 in a linkage generally designated at 26 in FIG. 2. A bracket 27 connected to the sill 12 supports the end of the bar 24 as well as one end of the linkage 26 which will be described in more detail.

Depending of course on the number of hoppers and discharge openings provided on the car, the same number of door assemblies are required. The clevis 21 and turnbuckle 22 are in effect thrust members for rotating one or more levers as the number of doors require. To actuate additional levers requires additional thrust bar extensions 28, as best shown in FIG. 3, the number of such extensions, of course, depending on the number of levers and door assemblies required. Obviously one lever may actuate one door on one side of the center sill, whereas other levers may actuate two doors depending on the number of openings and hoppers.

Referring now to FIGS. 3, 4 and 7, which disclose an improved arrangement, having however similar components as the prior art disclosure with the exception of the adjusting mechanism. In this improvement the lever 23 includes a pair of spaced plates 30 at their upper ends pivotally connected by a pin 31 to the elongated thrust bar extension 28 as shown in FIG. 4. As required by the number of hoppers, of course, additional thrust bar extensions 28 and levers 23 may be utilized.

The detail components of the door actuating assembly will now be described. Referring particularly to FIGS. 3 through 7, the plates 30 have connected thereto on opposite sides rigid blocks 31 having lower stop surfaces 32, provided with sockets 33. A rockable adjusting member is designated at 34 and includes a vertical plate type body portion 35 (with brass liner 35*a* surrounding shaft 45) having a rectangular opening 36, extending through said body portion 35. Oppositely disposed ears 37 project laterally outwardly of said body 35 immediately below and in alignment with the sockets 33. The ears each have threaded bores 38 in alignment with the sockets 33, and a threaded stud or cap screw 39 has a head portion 40, supported in alignment with each socket 33.

Each of the plates 30 is provided with bearing retainer openings 41 which rotatably support bearings 42. The bearing members 42 include flanges 43 and have rectangular bores 44 therethrough, each supporting a stub type of rectangular shaft 45 providing an effective rotatable actuating member. Each bearing 42 includes an inner circumferential portion 46 projecting slightly inwardly of the inner surfaces of the plates 30. The rectangular shafts 45 are in abutting engagement as indicated at 47 in FIG. 5, and any rotative movement of the lever 23 is imparted to the actuating member 45. Also the actuating members 45, may be independently rotatably adjusted as will presently be described.

Figure 8:
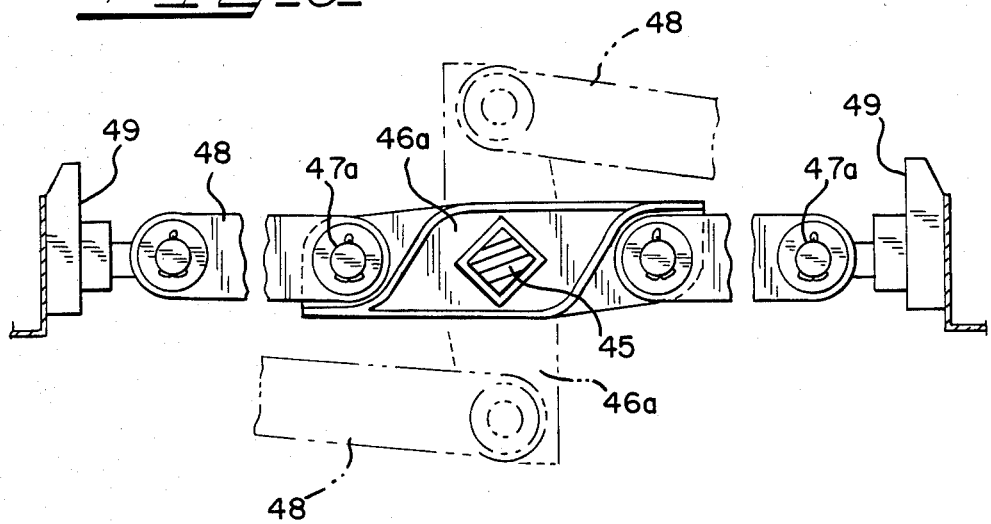
FIG. 8 is a detailed assembly of a conventional linkage arrangement connected to an actuating member for operating the doors and adjusting the same.

FIGS. 2, 3, and 8 disclose a linkage arrangement 26 for actuating the movement of the doors in response to the movement of the thrust bars 28 and associated structure. This is conventional in the prior art and FIG. 8 discloses details of the linkage. The arrangement is supported on the center sill by the brackets 27 and the ends of the actuating members 45 are secured in a rotating arm 46*a* which is pivotally connected as indicated at 47*a* to links 48, in turn connected to the door structures 16 by pivot brackets 49.

Operation

The operation of the doors is substantially similar in both the prior art and in the improvement. As the fluid actuated extensible device 17 moves the main lever 19 in clockwise direction, the levers 23 are moved counterclockwise which rotates the square actuating bars to rotate in counterclockwise direction. The arm 46*a* turns upright and the links 48 are moved toward each other which opens the door assemblies to their open position.

In order to adjust the doors of the prior art arrangement the turnbuckles must be operated. To some extent this adjustment will result in somewhat of an operative arrangement. However, because of its remote positioning and other factors, a fine adjustment of the type desired cannot be achieved. Thus the present preferred embodiment is desired and effective. The turnbuckles are eliminated and the adjustment can be made at the most desired place, namely at the lower end of the lever which is immediately disposed adjacent to the links which are involved. The operator merely loosens one of the screws 39, depending on which direction the adjustment is to be made, and by tightening the other screw the rockable adjusting member 34 is rotated to the desired position wherein the total dimension between the ends of the linkage can be shortened or increased depending on the particular condition required. In this manner sets of doors on opposite sides of the center sill are finely adjusted relative to the associated discharge openings. Rotative movement of the member 35 provides for rotative movement of the actuating bars, thus rotating the arm 46*a* to the desired adjusted position. The direct action of the rockable adjusting member 34, at the lower end of the lever 23 is immediately effective, easily operated, and provides for the finite adjustment desired. Thus the turnbuckles are eliminated and a much more effective design is achieved.

What is claimed is:

1. A railway hopper car including a hopper structure having a discharge opening, a frame supporting said hopper structure, a door assembly connected to said hopper structure for opening and closing discharge opening, a door operator supported on said frame including a movable thrust member, lever means connected to said thrust member, an actuating member projecting from the end of said lever means and being adjustably rotatable in the end of said lever means into a plurality of locked adjusted positions, linkage means connected to said actuating member and said door assembly for closing and opening the same during rotation of said lever means, and adjusting means engageable with said lever, and associated with said actuating member for rotating the same relative to said lever thereby adjusting the positioning of the linkage means of said door assembly relative to said door operator.

2. The invention in accordance with claim 1, said adjusting means including a movable member connected to a lower portion of said lever and carrying said actuating member for movement therewith, and means for locking said movable member in a plurality of adjusted positions.

3. The invention in accordance with claim 1, and said adjusting means carried on the actuating member and adjusting the position of the actuating member with respect to the lever means while maintaining the assembled condition of the lever means, the adjusting means, and the actuating member.

4. The invention in accordance with claim 1, said actuating member comprising a rotatable element projecting laterally outwardly from said lever.

5. The invention in accordance with claim 4, said lever means including a bearing opening, and bearing rotatable in said opening and supporting said rotatable element.

6. The invention in accordance with claim 5, said bearing opening being disposed in a lower portion of said lever means.

7. The invention in accordance with claim 6, said bearing having a rectangular opening, and said actuating member being secured in said opening.

8. The invention in accordance with claim 1, said lever means having a bearing opening in a lower portion of said lever means, a bearing rotatably mounted in said bearing opening supporting said actuating member, and said adjusting means including locking means for securing said actuating member in a plurality of rotated positions.

9. The invention in accordance with claim 8, said bearing having a rectangular socket, and said actuating member being supported in said socket for rotation therewith.

10. The invention in accordance with claim 9, including screw-type adjusting members on said bearing engageable with said lever for selectively locking said bearing in a plurality of adjusted positions.

11. The invention in accordance with claim 1, said adjusting means including a rotatable bearing element rotatably supported on bearing means at a lower portion of said lever means, said bearing element including a socket extending transversely with respect to said car, said actuating member being supported in said socket and projecting laterally outwardly with respect thereto to said linkage means, said adjusting means including an adjusting member rockably supported adjacent a lower portion of said lever means, said adjusting member being keyed to said actuating member, and means on said adjusting member engageable with said lever for locking said adjusting member in a plurality of different adjusted positions.

12. The invention in accordance with claim 11, said rockable adjusting member having opposite outwardly projecting first ears, locking elements adjustably supported in said first ears, said lever having opposite outwardly disposed second ears substantially in alignment with said first ears, said second ears being in abutting engagement with the locking elements of said first ears, and said locking elements being adjustable relative to said second ears to maintain said rockable adjusting member in said various positions.

13. The invention in accordance with claim 12, said locking elements comprising screw means.

14. The invention in accordance with claim 12, said second ears including sockets for receiving said adjustable locking elements in adjusted engagement.

15. The invention in accordance with claim 12, said lever means including spaced plate members, and said rockable adjusting member being disposed between said spaced plate members.

16. A railway hopper car including a hopper structure having a discharge opening, a frame supporting said hopper structure, a door assembly connected to said hopper structure for opening and closing said discharge opening, a door operator supported on said frame including a movable thrust member, lever means connected to said thrust member, an actuating member projecting from said lever means, linkage means connected to said actuating member and said door assembly for closing and opening the same during rotation of said lever means, and adjusting means engaging said lever and being associated with said actuating member for rotating the actuating member relative to said lever in the assembled condition of said lever means with said actuating member, thereby adjusting the position of the linkage means of said door assembly relative to said door operator.

17. The invention in accordance with claim 16, and the actuating member being attached to the adjusting means and constrained for rotation therewith.

18. The invention in accordance with claim 17, and said actuating member having a common axis of rotation with the adjusting means.

19. The invention in accordance with claim 17, and the lever means having a common axis of rotation with the actuating member and the adjusting means.

20. The invention in accordance with claim 16 and said actuating member extending from the end of the lever means and rotatably supported and adjusted with respect thereto, and said adjusting means being fixed on said actuating member and rotatably supported in the end of said lever means and engageable with said lever means attendant to rotating said actuating member.

21. The invention in accordance with claim 20 and said actuating member being rotatably supported at the end of the lever and adjusting means being fixed on said actuating member.

22. The invention in accordance with claim 21 and said actuating member having a common axis of rotation with the adjusting means.

23. The invention in accordance with claim 16 and said actuating member is fixedly attached to the adjusting means, and a bearing member is fixedly attached to the actuating member and rotates in the end of the lever means.

24. The invention in accordance with claim 23 and said actuating member extending into the adjusting means.

25. The invention in accordance with claim 24 and said actuating member extends into the bearing member.

* * * * *